US008335337B2

(12) United States Patent
Proni

(10) Patent No.: US 8,335,337 B2
(45) Date of Patent: Dec. 18, 2012

(54) LOUDSPEAKER WITH REPLACEABLE MOTOR ASSEMBLY

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 13/204,833

(22) Filed: Aug. 8, 2011

(65) Prior Publication Data

US 2011/0299717 A1 Dec. 8, 2011

Related U.S. Application Data

(62) Division of application No. 11/847,448, filed on Aug. 30, 2007.

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl. ..... 381/403; 381/433

(58) Field of Classification Search ..... 381/396, 381/400, 403, 405, 407, 411, 433
See application file for complete search history.

(56) References Cited

U.S. PATENT DOCUMENTS

| | | | | |
|---|---|---|---|---|
| 4,465,906 | A | 8/1984 | Adolph et al. | |
| 5,150,419 | A | 9/1992 | Kizak et al. | |
| 6,580,803 | B1 | 6/2003 | Peng | |
| 6,643,381 | B2 | 11/2003 | Tsai | |
| 6,757,402 | B2 | 6/2004 | Chan | |
| 6,778,677 | B2 | 8/2004 | Coffin | |
| 6,993,147 | B2 | 1/2006 | Guenther | |
| 7,003,130 | B2 | 2/2006 | Chung | |
| 7,025,170 | B2 | 4/2006 | Lin | |
| 7,030,522 | B2 | 4/2006 | Nakajima et al. | |
| 7,031,490 | B2 | 4/2006 | Stompler | |
| 7,142,685 | B2 | 11/2006 | Barnes | |
| 7,164,777 | B1 | 1/2007 | Stompler | |
| 7,167,573 | B2 | 1/2007 | Williamson | |
| 7,181,040 | B2 | 2/2007 | Ohta | |
| 7,212,647 | B2 | 5/2007 | Kaneda et al. | |
| 7,266,213 | B2 | 9/2007 | Furuya | |
| 7,505,603 | B2 | 3/2009 | Yoo | |
| 7,778,436 | B2 | 8/2010 | Chung et al. | |
| 7,873,178 | B2 | 1/2011 | Steere et al. | |
| 2002/0044671 | A1 * | 4/2002 | Shimomura et al. | 381/386 |
| 2003/0219142 | A1 * | 11/2003 | Stompler | 381/433 |
| 2005/0276438 | A1 | 12/2005 | Kobayashi et al. | |
| 2005/0281431 | A1 | 12/2005 | Watanabe | |

FOREIGN PATENT DOCUMENTS

| | | | |
|---|---|---|---|
| EP | 1703768 | A1 * | 9/2006 |

* cited by examiner

*Primary Examiner* — Charles Garber
*Assistant Examiner* — Calvin Choi
(74) *Attorney, Agent, or Firm* — GrayRobinson, P.A.

(57) ABSTRACT

A loudspeaker is provided in which precise alignment is obtained between the frame and motor assembly before they are connected to one another so that a voice coil coupled to the frame may be properly radially and vertically positioned with respect to a magnetic gap in the motor assembly while allowing the motor assembly and frame to be easily and quickly separated from one another to perform repairs or complete replacement of the motor assembly.

9 Claims, 15 Drawing Sheets

LOUDSPEAKER WITH REPLACEABLE MOTOR ASSEMBLY

CROSS-REFERENCE TO RELATED APPLICATIONS

The present application is a divisional of co-pending U.S. application Ser. No. 11/847,448 filed on Aug. 30, 2007, which is incorporated herein by reference in its entirety to form a part of the present disclosure.

FIELD OF THE INVENTION

This invention relates to loudspeakers, and, more particularly, to a loudspeaker having a replaceable motor assembly.

BACKGROUND OF THE INVENTION

Loudspeakers generally comprise a frame, a motor assembly, a voice coil, a diaphragm, a lower suspension or spider and a surround or upper suspension. In one type of speaker, the motor assembly includes a permanent magnet sandwiched between a top plate and a back plate, with a pole piece centrally mounted on the back plate so that both the top plate and magnet are concentrically disposed about the pole piece. A magnetic gap is formed between the pole piece and top plate within which the voice coil is axially movable. Preferably, the voice coil consists of a hollow, cylindrical-shaped former having an inner surface and an outer surface which mounts a winding of wire.

Other types of speakers, known as pot-type speakers, employ a motor assembly having a top plate, a pot structure including a pot wall integrally connected to a back plate and a permanent magnet sandwiched between a top plate and the back plate. A magnetic gap is formed between the pot wall and the top plate within which the voice coil is axially movable.

The voice coil in speakers of the type described above is mounted within the magnetic gap by the upper and lower suspensions and the diaphragm. One end of the diaphragm is connected to the upper suspension, which, in turn, is mounted to the upper end of the frame. The lower suspension is connected at one end to the frame at a point between its upper and lower ends. The free ends of the diaphragm and lower suspension may be mounted to the outer surface of the former of the voice coil and support it for axial movement within the magnetic gap. In many speaker designs, a dust cap is mounted over a central opening formed in the diaphragm so that contaminants are prevented from entering the interior of the speaker.

In the course of operation of speakers of the type described above, electrical energy is supplied to the voice coil causing it to axially move within the magnetic gap. The voice coil, diaphragm, upper suspension, lower suspension, and dust cap, if present, collectively form a "moving assembly" which reciprocates as a unit with the excursion of the voice coil.

The method of fabricating traditional loudspeakers such as noted above involves a process which takes place for the most part within the confines of the frame of the speaker. Initially, the frame is secured by screws, glue or other permanent fasteners to the motor assembly. In one type of speaker, the voice coil is then placed over the pole piece of the motor assembly, and a centering gauge is positioned between the voice coil and pole piece. The gap between the voice coil and pole piece, as well as the height of the voice coil within the overall speaker, are set at this stage of the assembly operation with the centering gauge in place. A similar assembly operation is employed with pot-type speakers to accurately position the voice coil in the magnetic gap between the pot wall and top plate.

After the voice coil is positioned relative to the pole piece or pot wall, the spider or lower suspension is slid along the outer surface of the voice coil, from the top downwardly, until the outer periphery of the lower suspension rests against a spider plateau or seat formed in the frame. When seated, the lower suspension is glued to both the outer surface of the voice coil and to the spider plateau.

Many loudspeaker manufacturers purchase the upper suspension and the diaphragm as a pre-assembled unit from a third party. With the lower suspension in place, the diaphragm of the upper suspension—diaphragm unit is slipped over the voice coil and glued in place on the outer surface of the former. The outer periphery of the upper suspension is then glued to an upper flange of the frame, and a gasket is attached to such upper flange outside of the upper suspension. Once all the glue has cured, the voice coil gauge is removed from between the voice coil and pole piece by pulling it upwardly through the central opening formed in the diaphragm. A dust cap is then glued to the diaphragm over its central opening.

Beginning with the pole piece or pot wall of the motor structure, essentially the entire speaker consists of elements which are intended to be oriented in concentric relation to one another. The voice coil is concentric to the pole piece or pot wall, and the upper suspension, lower suspension and diaphragm are concentric to the voice coil. Each of these elements is made within certain tolerances, and the tolerance "stack-up" or combined total from the voice coil radially outwardly to the upper suspension can be significant. Further, no effort is typically made to obtain fine alignment between the frame and motor assembly which can add to tolerance stack-up problems, i.e., the seat or spider plateau in the frame where one end of the lower suspension is mounted, and the upper flange of the frame where the upper suspension is mounted, can be out of concentricity with respect to the pole piece or pot wall of the motor structure. In most speaker designs, the total concentric tolerance stack-up must be absorbed by the upper suspension. Especially during high excursion of the voice coil, the upper suspension can deform if the tolerance stack-up is too high, causing the voice coil to "rock" or pivot within the magnetic gap. This can severely degrade the performance of the speaker.

Another problem with prior loudspeakers and their method of manufacture involves repairs and warranty work. As noted above, many of the speaker elements are permanently attached together with glue. In the event of a failure of a speaker element, a great deal of time and effort must be expended to clean the surfaces where glue has been applied before a new part can be installed. Often, it is less expensive and time consuming to simply replace entire portions of the speaker, including the entirety of the motor assembly, rather than to attempt to repair a failed part.

SUMMARY OF THE INVENTION

The loudspeaker of this invention provides for precise alignment between the frame and motor assembly so that the voice coil is properly positioned both in the radial and vertical directions with respect to the magnetic gap, while permitting the frame and motor assembly to be easily and quickly separated from one another to facilitate the performance of warranty work, other repairs and/or the replacement of the motor assembly in its entirety.

The loudspeaker of this invention is preferably a pot-type speaker having a frame with a voice coil, and a motor assembly. The motor assembly of the speaker includes a pot structure comprising a vertically extending pot wall integrally formed with a back plate, which is oriented generally parallel to a top plate, with a permanent magnet located between the back plate and the top plate. A magnetic gap is formed between the pot wall and top plate within which the voice coil is axially movable.

In one presently preferred group of embodiments of this invention, the lower end of the frame is formed with a seat having a radial alignment surface and a vertical alignment surface. Similarly, the pot structure is formed with both radial and vertical alignment surfaces. In these embodiments, an element such as a flange or plate protrudes radially outwardly from the pot structure. The upper surface of the flange forms the vertical alignment surface of the pot structure, and the radial alignment surface may be the outer edge of the flange or the exterior surface of the pot wall. When the frame is placed into engagement with the motor assembly, the vertical alignment surface of the frame contacts the upper surface of the flange or plate, and the radial alignment surface of the frame engages the exterior surface of the pot wall or the outer edge of the flange. These aligning surfaces of the frame and pot structure ensure that the voice coil coupled to the frame is accurately positioned, both in a vertical and radial direction, within the magnetic gap of the motor assembly. Fasteners connect the motor assembly to the frame.

In another group of preferred embodiments of this invention, the desired radial alignment of the voice coil within the magnetic gap of the motor assembly is achieved by the engagement between a radial alignment surface formed on the lower end of the frame and the exterior surface of the pot wall of the motor assembly. In order to ensure that the voice coil is properly vertically aligned within the magnetic gap, the pot structure is formed with notches which receive projections extending from the lower end of the frame when the frame is fitted over the motor assembly. The projections can take the form of set screws or flexible arms carried by the lower end of the frame. When each projection is seated within a corresponding notch in the pot structure, the voice coil is in the appropriate vertical relationship with respect to the magnetic gap.

A still further embodiment of this invention employs a flange extending radially outwardly from the pot structure. The flange has an upper surface and a number of circumferentially spaced holes. The lower end of the frame includes a vertical alignment surface, and a number of circumferentially spaced pins. When the frame is fitted onto the motor assembly, the pins are received within the holes in the flange to provide radial alignment of the voice coil with respect to the magnetic gap. The vertical alignment surface of the frame rests atop the upper surface of the flange to accurately vertically locate the voice coil in the magnetic gap.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
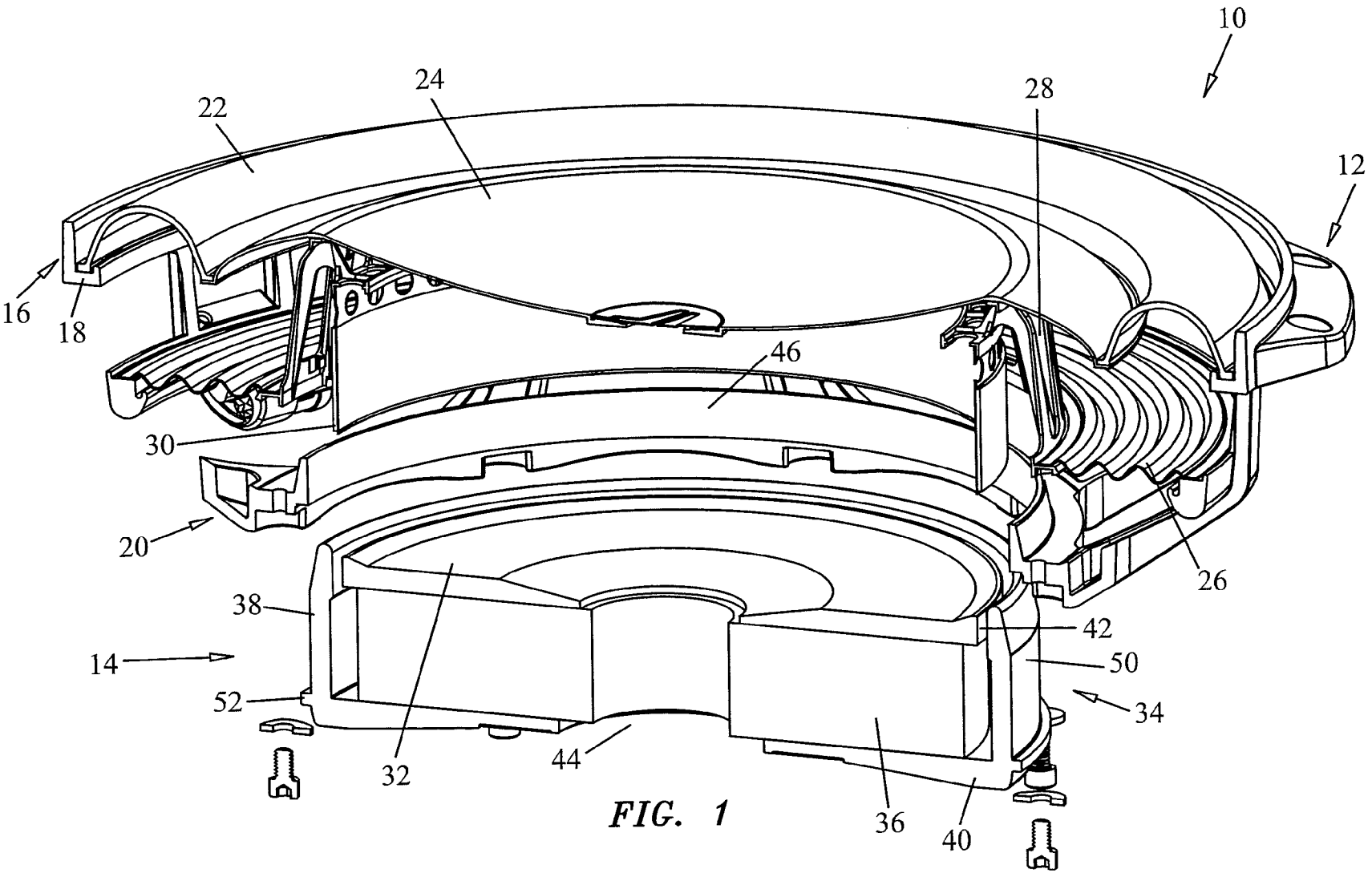
FIG. 1 is an exploded cross sectional view of one embodiment of the loudspeaker of this invention.
Figure 2:
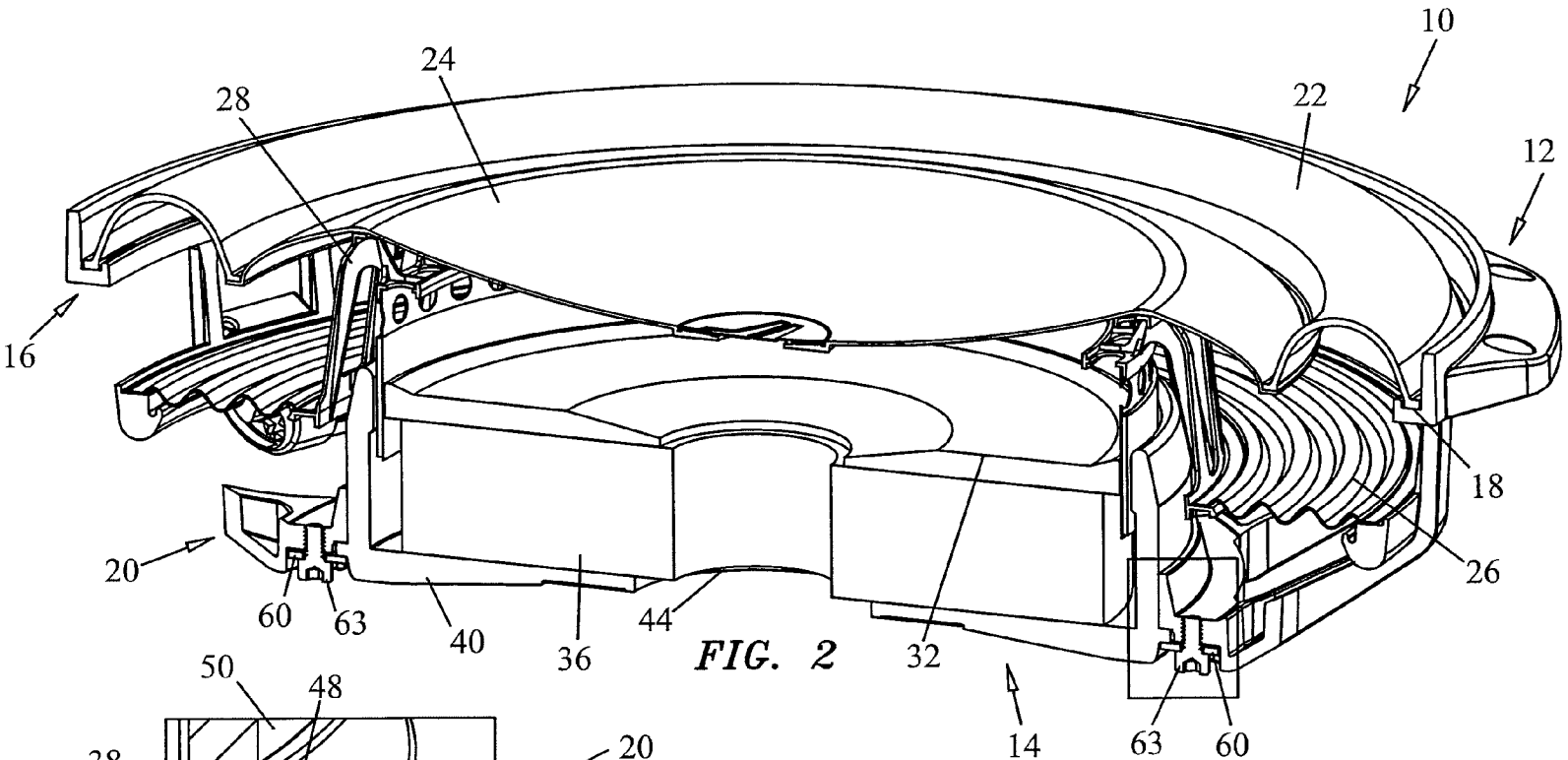
FIG. 2 is a view similar to FIG. 1 except with the loudspeaker assembled.
Figure 2A:
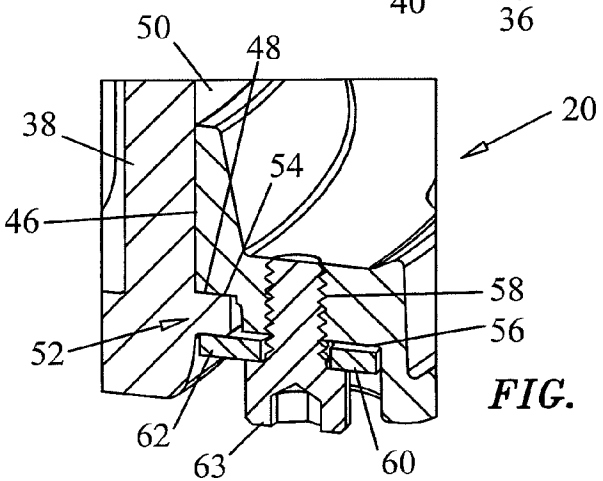
FIG. 2A is an enlarged view of the encircled portion of FIG. 2 depicting the alignment and connection between the frame and motor assembly.

Referring now to the drawings, a number of alternative embodiments of a pot-type loudspeaker 10 are illustrated which have a substantial amount of common structure but variations of how the frame 12 of the speaker 10 and its motor assembly 14 may be mounted together so as to permit quick and easy separation of the frame 12 and motor assembly 14 from one another while ensuring that accurate alignment between the two is obtained upon assembly. The common elements of the speaker 10 are initially, described below, followed by a discussion of distinct embodiments of the alignment structure. FIGS. 1 and 2 depict the entire structure of the loudspeaker 10 associated with the frame 12. For ease of illustration and discussion, the remaining Figs. illustrate only a cross sectional view of the lower portion of the frame 12 and the motor assembly 14 but it should be understood that the loudspeakers 10 therein have the same structure within frame 12 as in FIGS. 1 and 2. For purposes of the present discussion, the terms "upper," "lower," "inner," "outer," "top," "bottom," "vertical" and the like refer to the orientation of the speaker 10 as it appears in the Figs.

Common Speaker Elements

With reference initially to FIGS. 1 and 2, the frame 12 of the speaker 10 has an upper end 16 formed with a circumferentially extending recess 18 and a lower end 20. The recess 18 mounts one end of a surround 22, whose opposite end connects to a diaphragm 24. One end of a lower suspension or spider 26 is mounted to approximately the midpoint of the frame 12, and its opposite end supports a collar 28 having an, upper end which is mounted to a voice coil 30 and to the underside of the diaphragm 24. The surround 22, diaphragm 24, spider 26 and voice coil 30 form the "moving assembly" of the speaker 10 in that they collectively move in an axial direction with respect to the frame 12 and motor assembly 14 when electrical energy is supplied to the voice coil 30.

The motor assembly 14 comprises a top plate 32, a pot structure 34 and a permanent magnet 36. The pot structure 34 consists of a vertically extending pot wall 38 which connected to or integrally formed with a back plate 40. The top plate 32 and back plate 40 are oriented generally parallel to one another with the magnet 36 located between them. A magnetic gap 42 is formed in the space between the pot wall 38 and top plate 32 within which the voice coil 30 is axially movable. In order for the speaker 10 to operate properly, the voice coil 30 must be accurately aligned within the magnetic gap 42 both radially and vertically. The terms "radial" and "radially" used herein in discussing alignment of the voice coil 30 or the location of different elements of the speaker 10 refer to a direction radially outwardly from the center of the speaker 10, i.e. generally coincident with the center of the bore 44 in the magnet 36. The discussion which follows is directed to the structure of the various embodiments of the speaker 10 of this invention for achieving accurate radial and vertical alignment of the voice coil 30 within the magnetic gap 42, while allowing the motor assembly 14 and frame 12 to be readily separated from one another.

Embodiments of FIGS. 1-8A

Although somewhat different from one another, the embodiments of this invention shown in FIGS. 1-8A are related in that an element protruding from the pot structure 34 engages corresponding structure on the lower end 20 of the frame 12 to obtain the desired vertical and radial alignment of the voice coil 30 within the magnetic gap 42.

Figure 3:
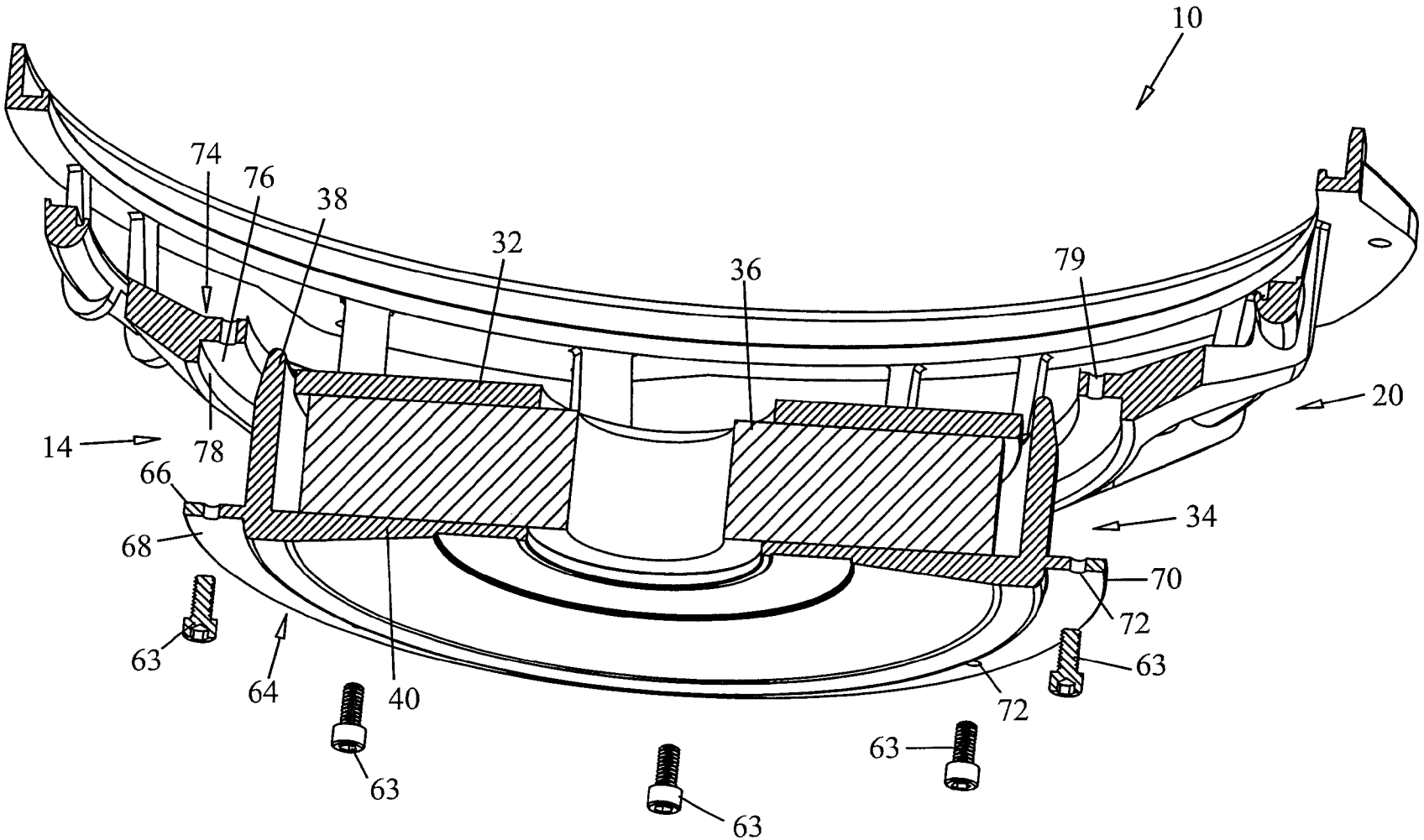
FIG. 3 is a partial, exploded cross sectional view of another embodiment of the loudspeaker of this invention.

Referring initially to FIGS. 1-3, the lower end 20 of frame 12 is formed with a seat 44 having a radial alignment surface 46 and a vertical alignment surface 48 oriented at approximately 90° to one another, The pot wall 38 has an exterior surface 50, and an annular ring 52, having an upper surface 54, protrudes radially outwardly from the pot structure 34. The underside of the lower end 20 of the frame 12 is formed with a number of circumferentially spaced recesses 56, and a tapped bore 58 is centered on each recess 56 which extends into the frame 12.

In order to assemble the speaker 10 depicted in FIGS. 1-3, the frame 12 is fitted onto the motor assembly 14 such that the radial alignment surface 46 contacts the exterior surface 50 of the pot wall 38. The frame 12 extends downwardly onto the motor assembly 14 until the vertical alignment surface 48 of its lower end 20 engages the upper surface 54 of the annular ring 52. The exterior surface 50 of the pot wall 38 and radial alignment surface 46 of the frame 12 are dimensioned such that the voice coil 30 is correctly radially positioned within the magnetic gap 42. Similarly, the height relationship between the upper surface 54 of the annular ring 52 and the vertical alignment surface 48 of the frame lower end 20 ensures that the voice coil 40 is accurately vertically aligned within the magnetic gap 42. Once the frame 12 and motor assembly 14 are thus positioned, washers 60 are placed within the recesses 56 on the underside of the lower end 20 of frame 12 such that a portion of the washers 60 engage the bottom surface 62 of the annular ring 52. Screws 63 are then threaded into the bores 58 to tighten the frame 12 down onto the motor assembly 14.

Figure 4:
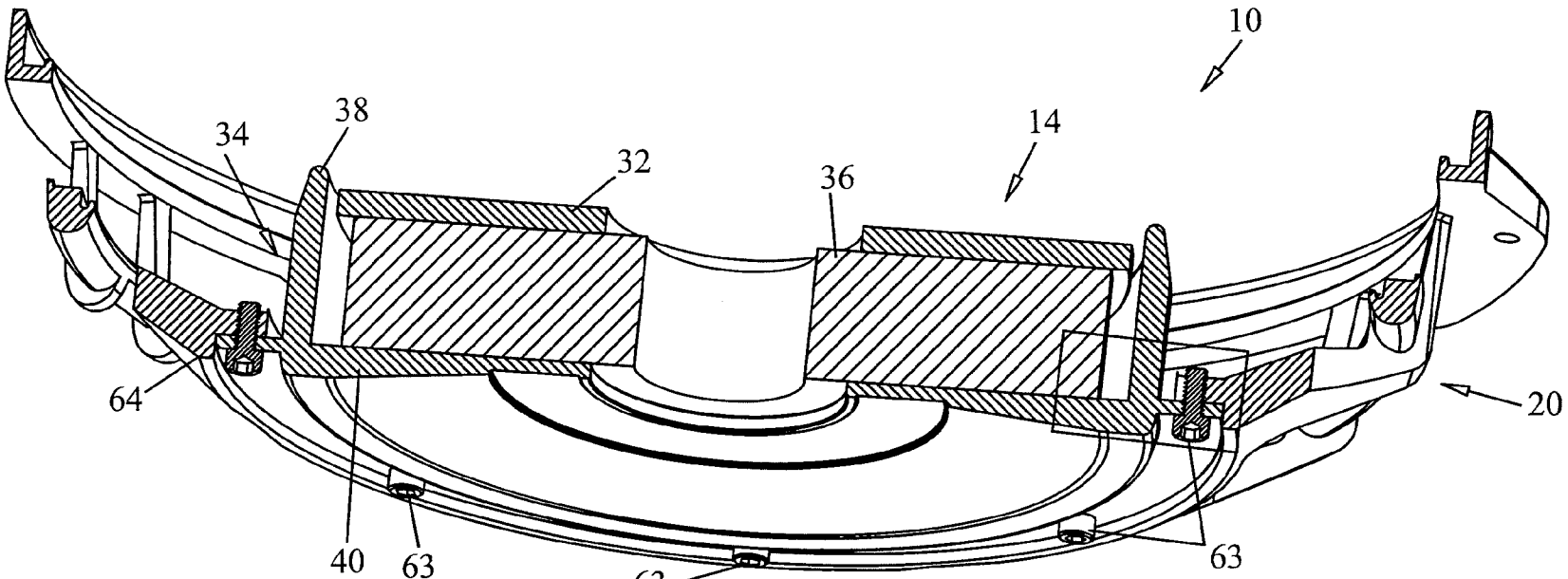
FIG. 4 is a view similar to FIG. 3 except with the loudspeaker assembled.
Figure 4A:
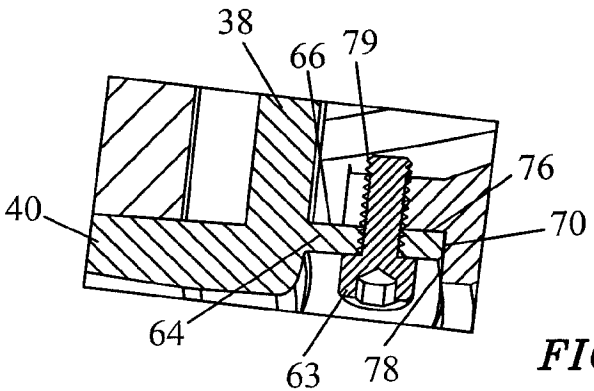
FIG. 4A is an enlarged view of the encircled portion of FIG. 2 depicting the alignment and connection between the frame and motor assembly.

An alternative embodiment of this invention is shown in FIGS. 3-4A. An annular flange 64 having an upper surface 66, a lower surface 68 and an outer edge 70 extends radially outwardly from the pot structure 34. The flange 64 is formed with a number of spaced bores 72. The lower end 20 of the frame 12 has a seat 74 in the general shape of an upside-down "L" defining a vertical alignment surface 76 and a radial alignment surface 78. When the frame 12 and motor assembly 14 are fitted together, the vertical alignment surface 76 of the frame 12 contacts the upper surface 66 of the annular flange 64, and the radial alignment surface 78 of the frame 12 rests against the outer edge 70 of the flange 64. The engagement of these surfaces provides vertical and radial alignment, respectively, of the voice coil 30 relative to the magnetic gap 42. The frame 12 and motor assembly 14 are connected together by inserting screws 63 through the bores 72 in the flange 64 into tapped holes 79 in the lower end 20 of the frame 12.

Figure 5:
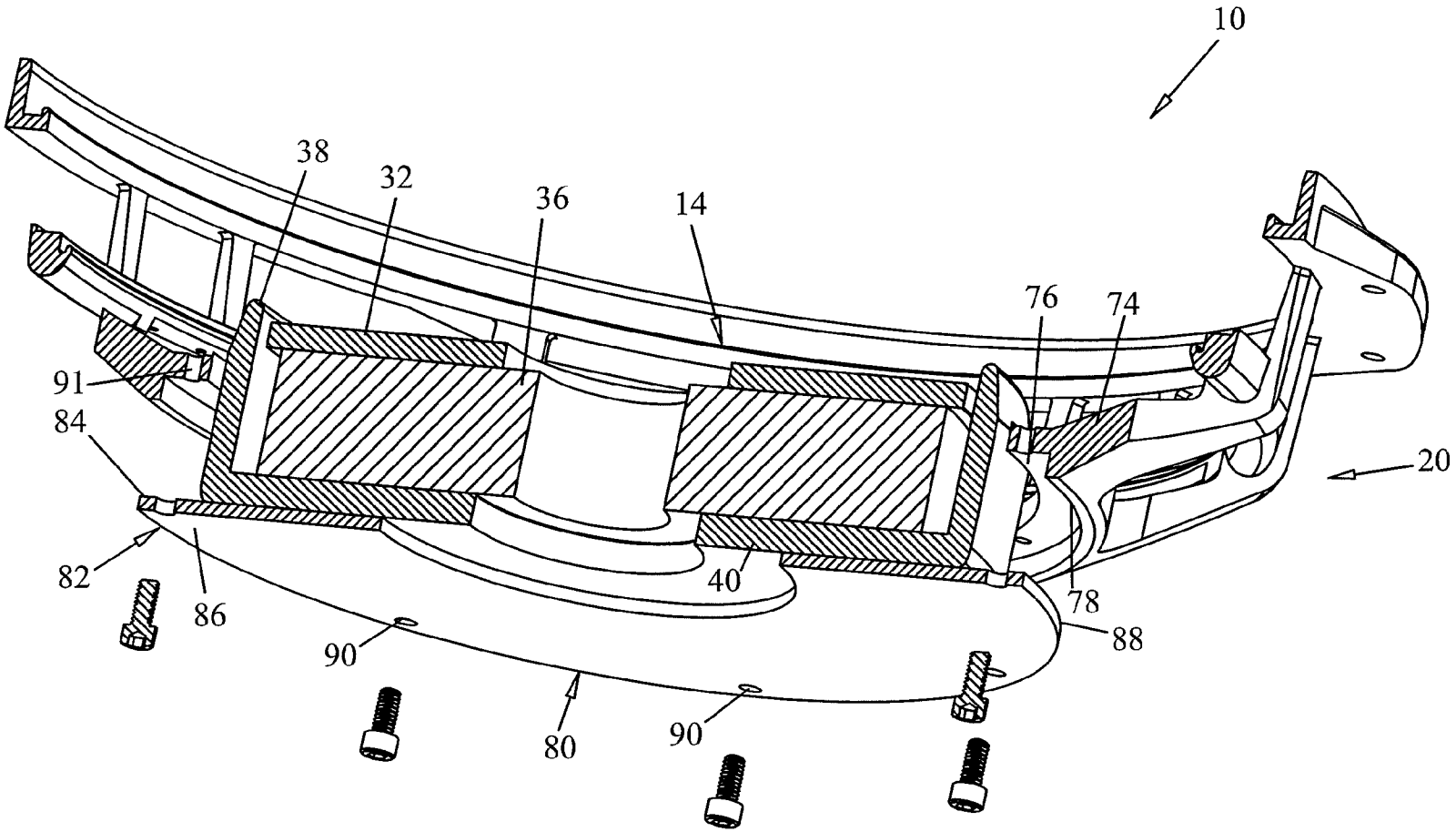
FIG. 5 is a partial, exploded cross sectional view of a further embodiment of the loudspeaker of this invention.
Figure 6:
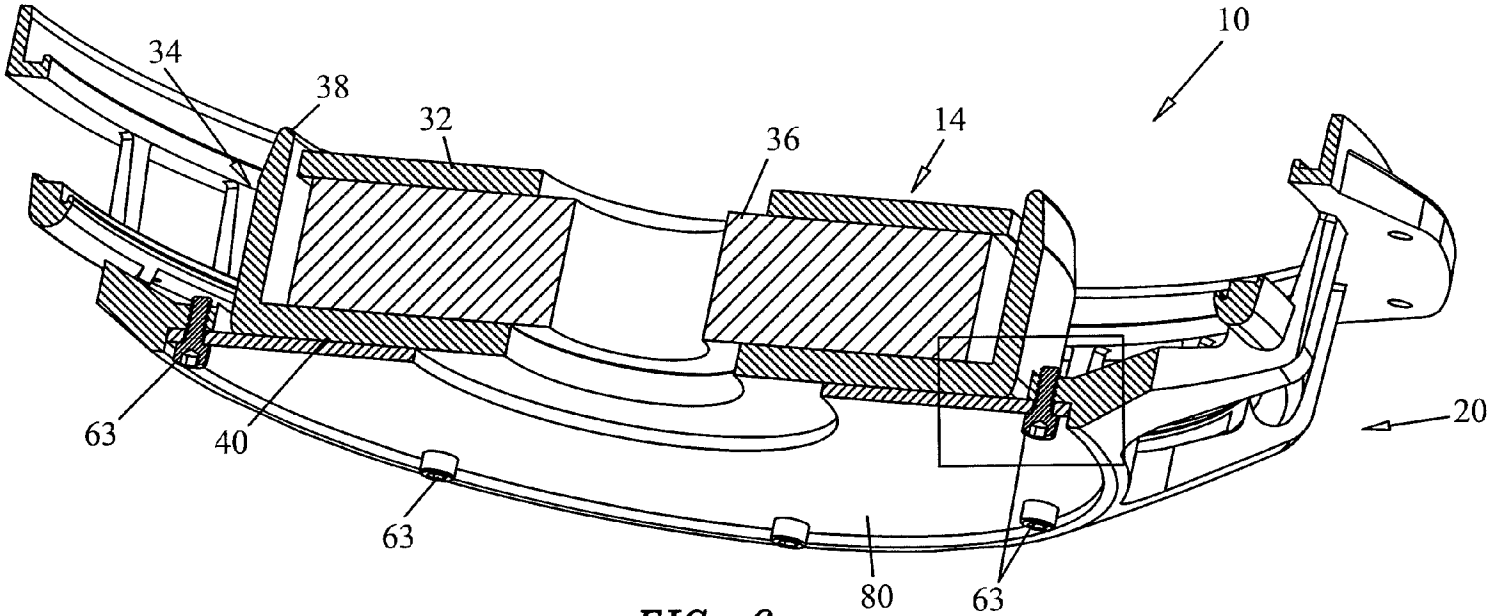
FIG. 6 is a view similar to FIG. 5 except with the loudspeaker assembled.
Figure 6A:
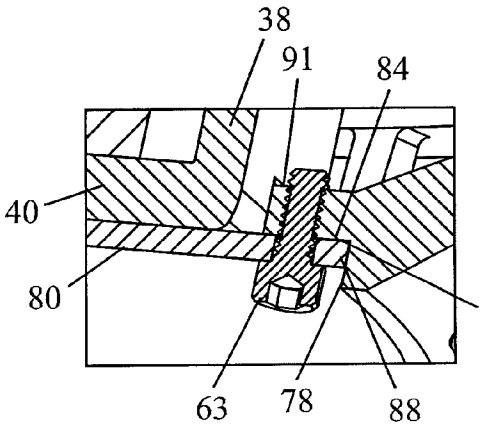
FIG. 6A is an enlarged view of the encircled portion of FIG. 6 depicting the alignment and connection between the frame and motor assembly.

A similar concept to that described in connection with a discussion of FIGS. 3-4A is shown in FIGS. 5-6A, except instead of a flange 64 an annular motor mounting plate 80 is employed having an outer portion 82 which protrudes radially outwardly from the pot structure 34. The outer portion 82 of plate 80 has an upper surface 84, a lower surface 86 and a radial alignment edge 88. A number of circumferentially spaced bores 90 extend through the outer portion 82 of plate 80. The lower end 20 of the frame 12 is formed with the same seat 74 as in the embodiment of FIGS. 3-4A with the vertical and radial alignment surfaces 76 and 78. When the frame 12 and motor assembly 14 are fitted together, the vertical alignment surface 76 of the frame 12 contacts the upper surface 84 of the outer portion 82 of plate 80, and the radial alignment surface 78 of the frame 12 rests against the radial alignment edge 88 of the plate 80. The engagement of these surfaces provides vertical and radial alignment, respectively, of the voice coil 30 relative to the magnetic gap 42. The frame 12 and motor assembly 14 are connected together by inserting screws 63 through the bores 90 in the outer portion 82 of the plate 80 into tapped holes 91 in the lower end 20 of the frame 12.

Figure 7:
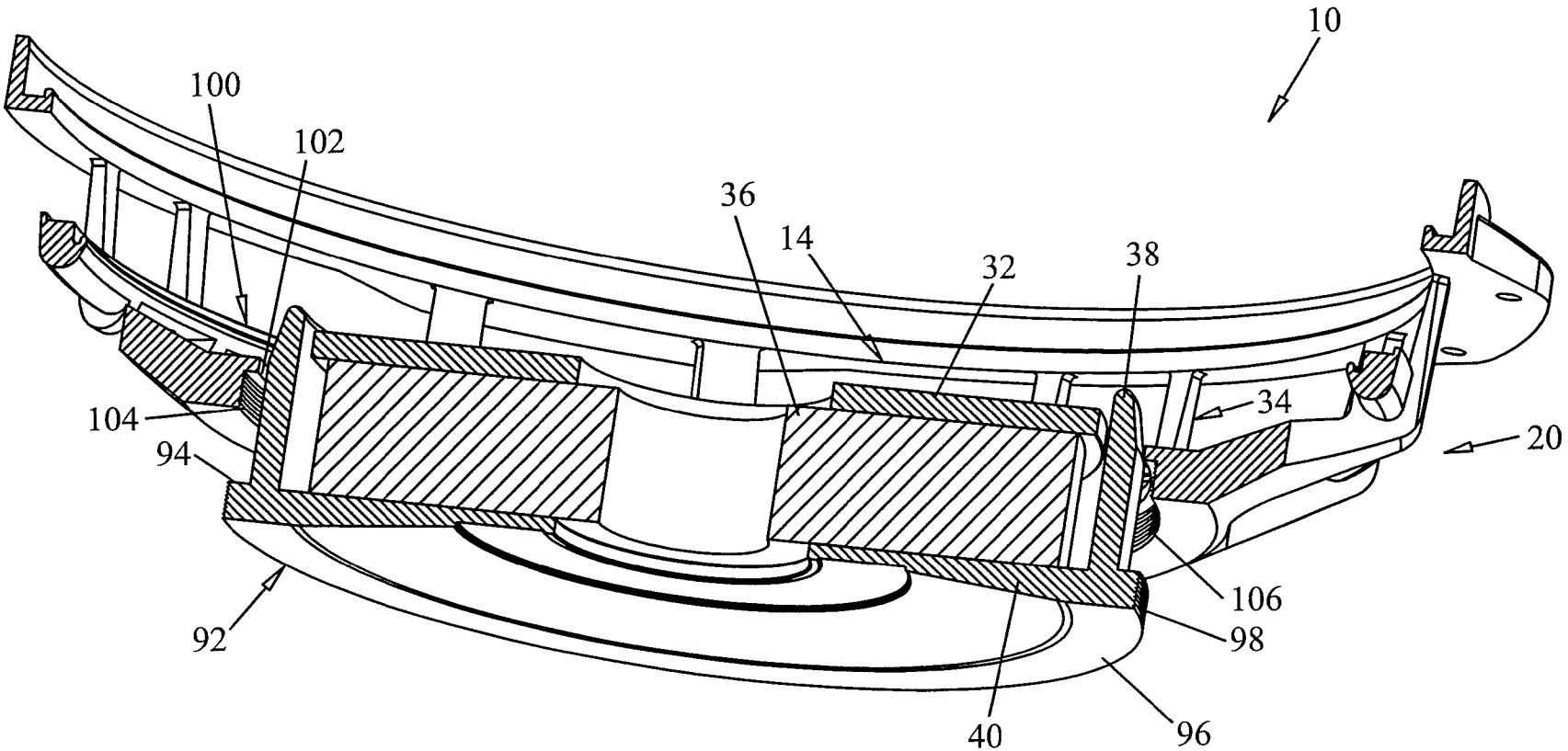
FIG. 7 is a partial, exploded cross sectional view of a still further embodiment of the loudspeaker of this invention.
Figure 8:
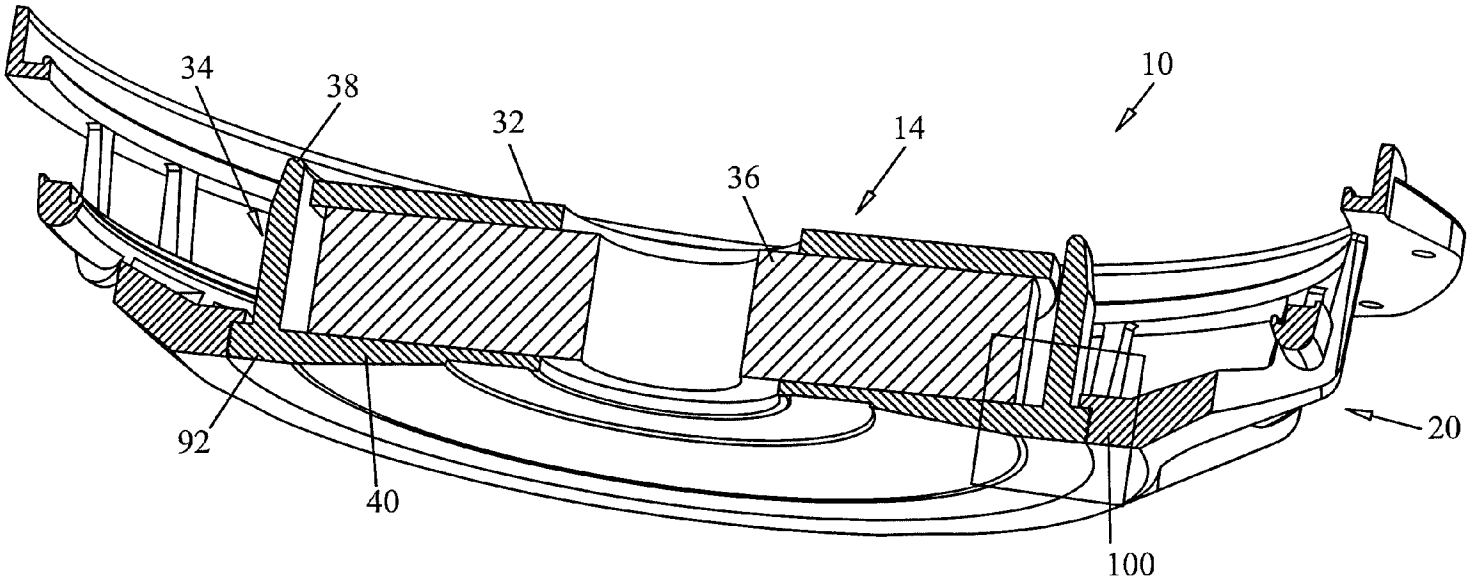
FIG. 8 is a view similar to FIG. 7 except with the loudspeaker assembled.
Figure 8A:
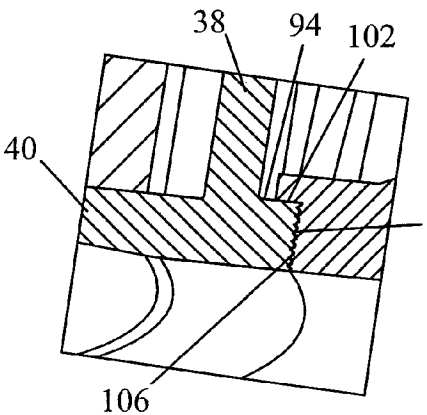
FIG. 8A is an enlarged view of the encircled portion of FIG. 8 depicting the alignment and connection between the frame and motor assembly.

Referring now to FIGS. 7-8A, a similar concept to that described in connection with a discussion of FIGS. 3-4A, except different structure is employed to mount the frame 12 to the motor assembly 14. A flange 92 protrudes radially outwardly from the pot structure 34 having an upper surface 94 and an annular edge 96 formed with first threads 98. The lower end 20 of the frame 12 is formed with a seat 100 including a vertical alignment surface 102 and a radial alignment surface 104 having second threads 106. In order to connect the frame 12 to the motor assembly 14, the annular edge 96 of the flange 92 and the radial alignment surface 104 of the lower end 20 of frame 12 are threaded together by engagement of their respective first and second threads 98, 106. This connection between the lower end 20 of the frame 12 and the flange 92 provides accurate radial alignment of the voice coil 30 within the magnetic gap 42. The frame 12 and motor assembly 14 are threaded together until the upper surface 94 of the flange 92 engages the vertical alignment surface 102 of the lower end 20 of frame 12. This seats the motor assembly 14 against the frame 12, and provides accurate vertical alignment of the voice coil 30 within the magnetic gap 42.

Embodiments of FIGS. 9-13A

Referring now to FIGS. 9-13A, alternative embodiments of mounting and alignment structure for the frame 12 and motor assembly 14 are provided which do not involve the use of a member protruding radially outwardly from the pot structure 34 as in the previously described embodiments. Instead, radial alignment is achieved by the engagement of frame structure with the exterior surface 50 of the pot wall 38, and vertical alignment involves the insertion of a set screw or projection from the frame 12 into a notch formed in the pot structure 34.

Figure 9:
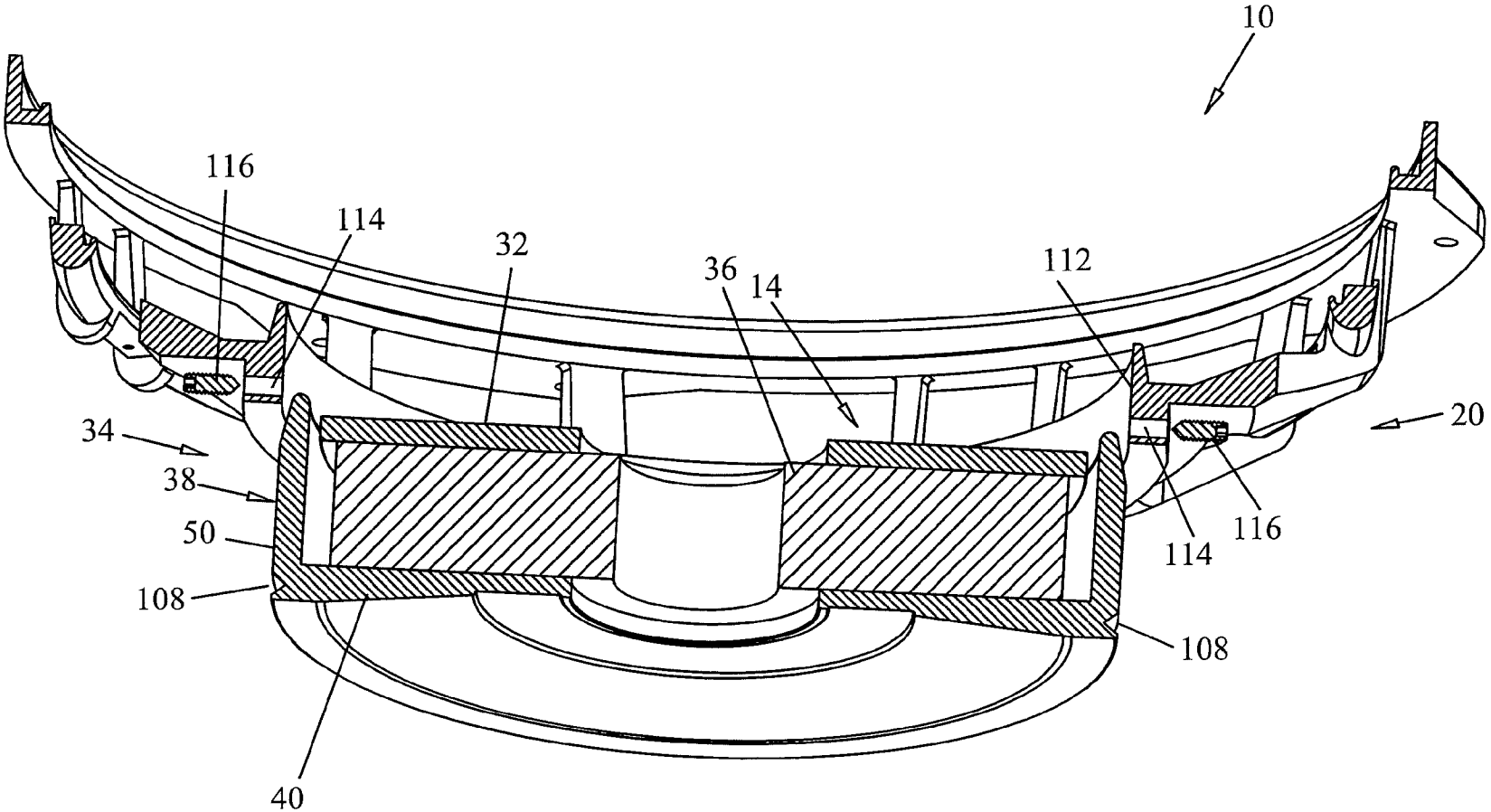
FIG. 9 is a partial, exploded cross sectional view of still another embodiment of the loudspeaker of this invention.
Figure 10:
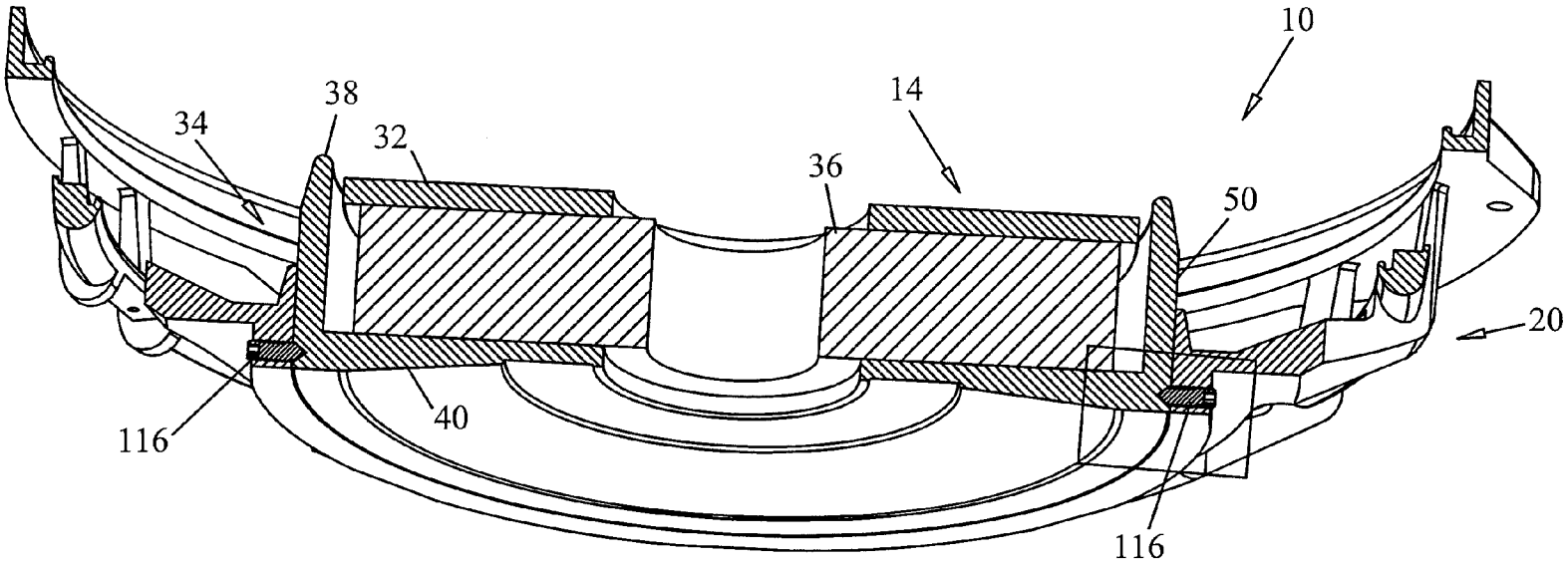
FIG. 10 is a view similar to FIG. 9 except with the loudspeaker assembled.
Figure 10A:
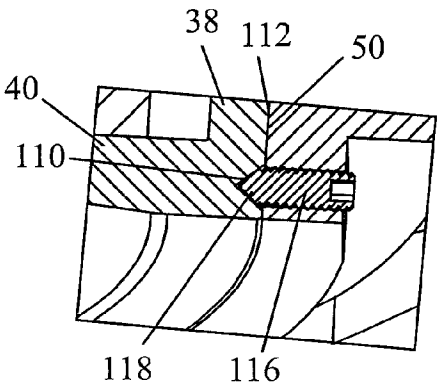
FIG. 10A is an enlarged view of the encircled portion of FIG. 10 depicting the alignment and connection between the frame and motor assembly.
Figure 11:
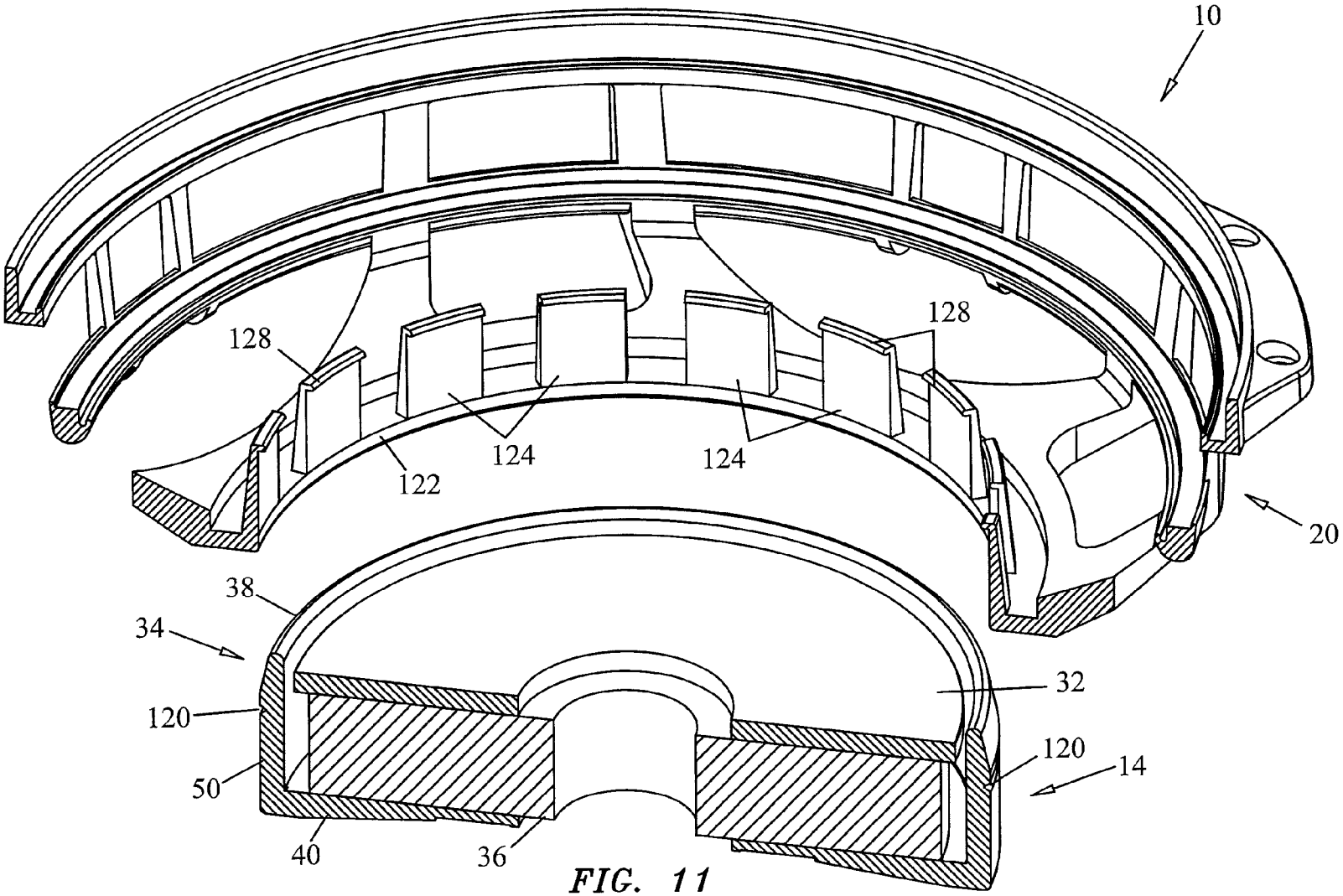
FIG. 11 is a partial, exploded cross sectional view of another embodiment of the loudspeaker of this invention.

In the specific embodiment of FIGS. 9-10A, a number of generally V-shaped notches 108 are formed in the pot structure 34 at the juncture of the pot wall 38 and back plate 40, one of which is shown in the Figs. Each notch 108 is oriented generally horizontally as depicted in FIGS. 9-10A, and has a vertical alignment surface 110 along the upper portion thereof. The lower end 20 of the frame 12 has a radial alignment surface 112, and tapped through bores 114 equal in number to the notches 108 in the pot structure 34. When the frame 12 is fitted onto the motor assembly 14, the radial alignment surface 112 of the frame 12 contacts and slides along the exterior surface 50 of the pot wall 38 so that the voice coil 30 is accurately aligned within the magnetic gap 42. The frame 12 extends downwardly relative to the motor assembly 14 until the through bores 114 in the lower end of the frame 12 align with the notches 108 in the pot structure 34. A set screw 116 or the like, preferably having an arrowhead-shaped tip 118, is threaded through each bore 114 until the tip 118 seats within one of the notches 108. Engagement between the tip 118 of a set screw 116 and the vertical alignment surface 110 of a notch 108 ensures that the voice coil 30 is accurately vertically aligned within the magnetic gap 42. The set screws 116 also function to connect the frame 12 and motor assembly 14 together.

The embodiment of this invention illustrated in FIGS. 11-13A is similar to that of FIGS. 9-10A in that it employs a notch in the pot structure 34, but different structure associated with the frame 12 is received within the notch to provide the required vertical alignment. The pot structure 34 is formed with a horizontally oriented V-shaped notch 120 having a vertical alignment surface 121, but in this embodiment the notch 120 is located near the upper portion of the pot wall 38. The lower end 20 of the frame 12 is formed with a radial alignment surface 122, and a number of flexible arms 124 which are circumferentially spaced from one another. Each of the flexible arms 124 extends upwardly from the lower end 20 of the frame 12, but at a slight inward angle relative to vertical, and terminates at a radially inwardly extending tip 128. See FIG. 11.

Figure 12:
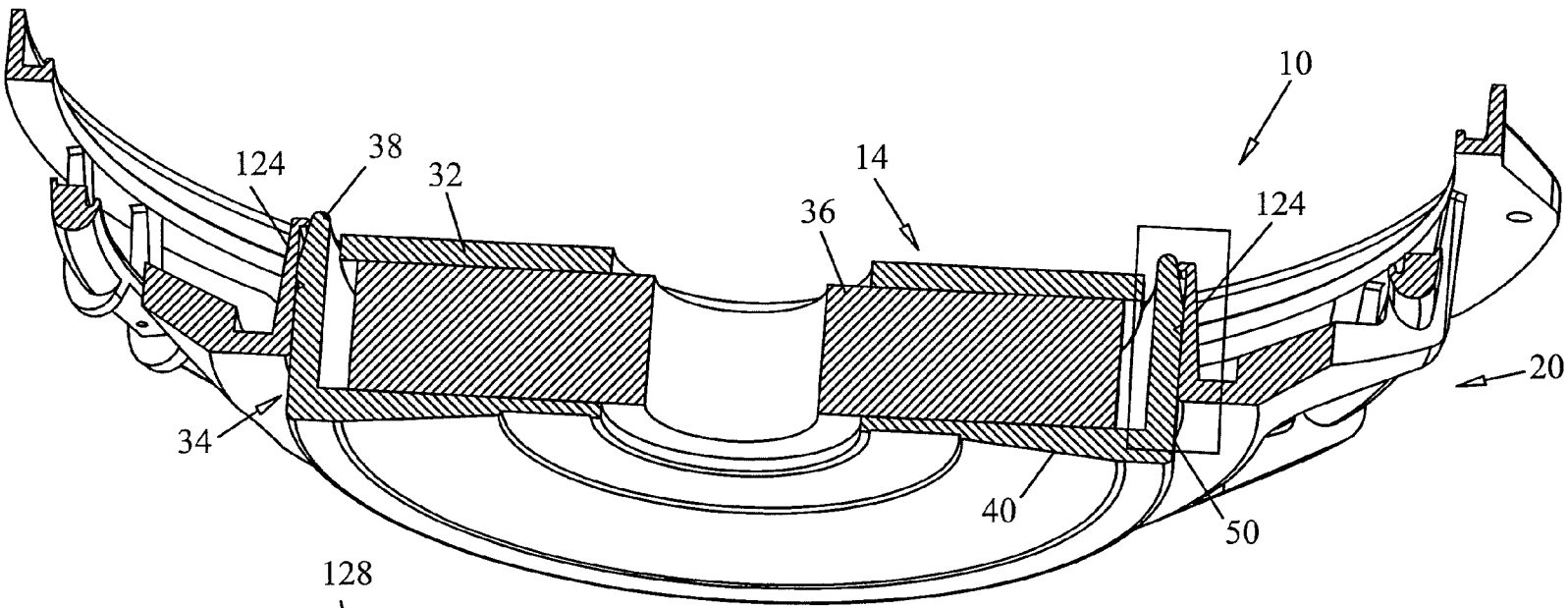
FIG. 12 is a view similar to FIG. 11 except with the loudspeaker in the process of being assembled.
Figure 12A:
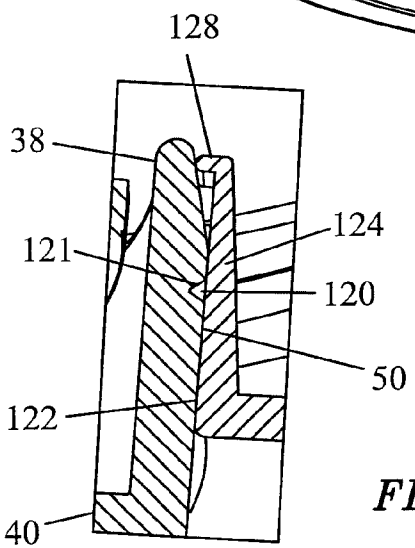
FIG. 12A is an enlarged view of the encircled portion of FIG. 12 showing the frame and motor assembly partially connected to one another.
Figure 13:
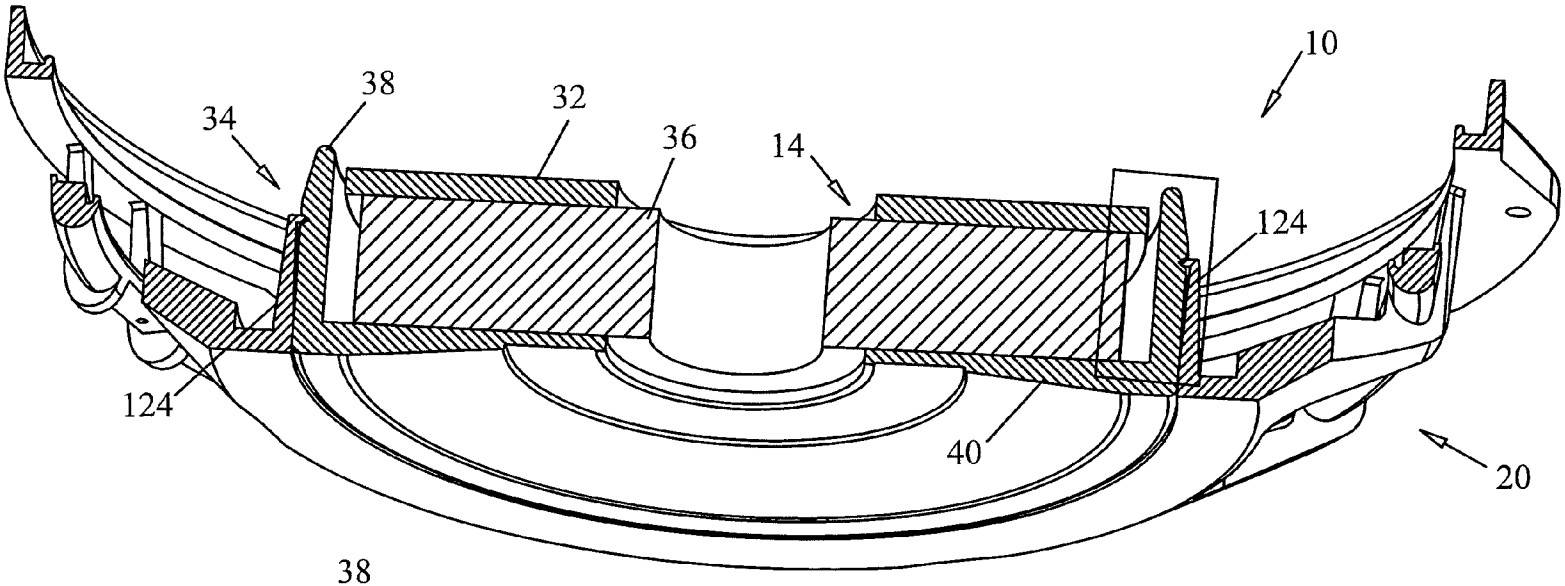
FIG. 13 is a view similar to FIG. 12 except with the loudspeaker fully assembled.
Figure 13A:
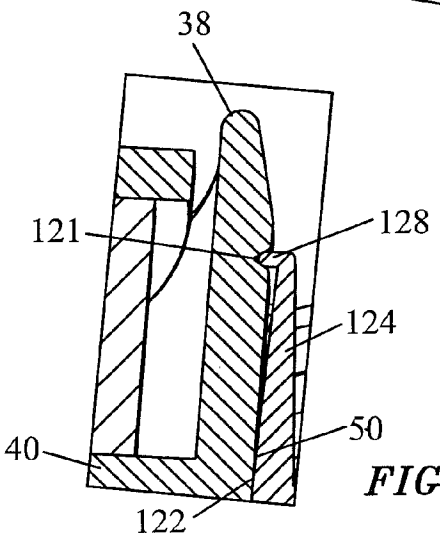
FIG. 13A is an enlarged view of the encircled portion of FIG. 13 illustrating the alignment and connection between the frame and motor assembly.

As shown in FIGS. 12 and 12A, the frame 12 may be fitted onto the pot structure 34 of the motor assembly 14 such that the radial alignment surface 122 of the lower end 20 contacts and slides along the exterior surface 50 of the pot wall 38. The tip 128 of each arm 124 engages the pot wall 38 and deflects radially outwardly to some extent from its original angular orientation. It is contemplated that the arms 124 may be formed of plastic, thin metal or other resilient material to permit such deflection without requiring the application of undue force in fitting the frame 12 and motor assembly 14 together. The radial alignment surface 122 of the frame 12 and exterior surface 50 of the pot wall 38 are dimensioned so as to ensure that the voice coil 30 is accurately aligned within the magnetic gap 42. The frame 12 continues to move downwardly relative to the motor assembly 14, as viewed in FIGS. 13 and 13A, until the tip 128 of each arm 124 seats within a notch 120 in the pot wall 38. Preferably, the tips 128 of the flexible arms 124 are rounded so as to engage the vertical alignment surface 121 of a corresponding notch 120 and thus ensure accurate vertical alignment of the voice coil 30 within the magnetic gap 42. The flexible arms 124 also function to connect the frame 12 and motor assembly 14 together.

Figure 14:
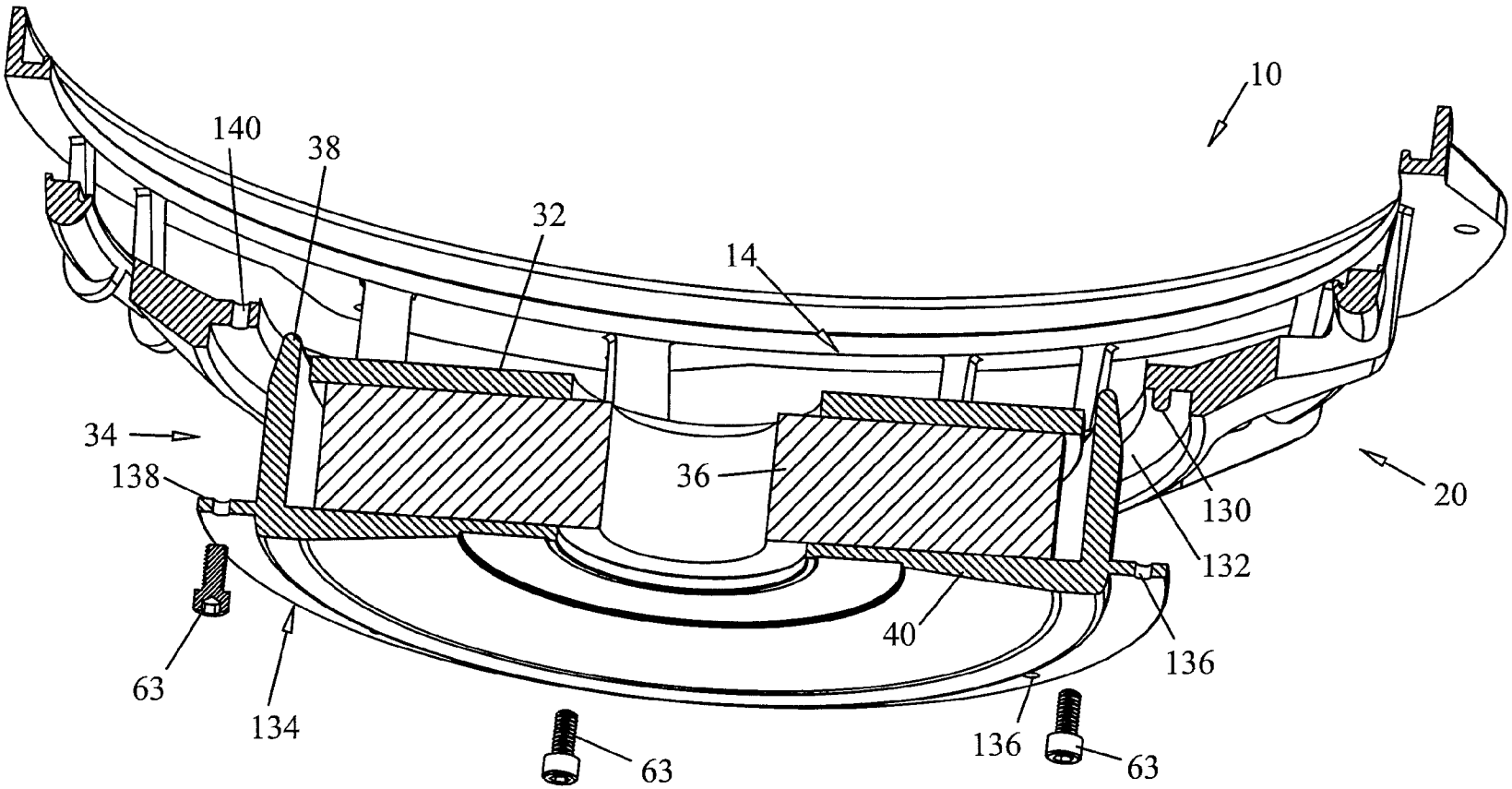
FIG. 14 is a partial, exploded cross sectional view of still another embodiment of the loudspeaker of this invention.
Figure 15:
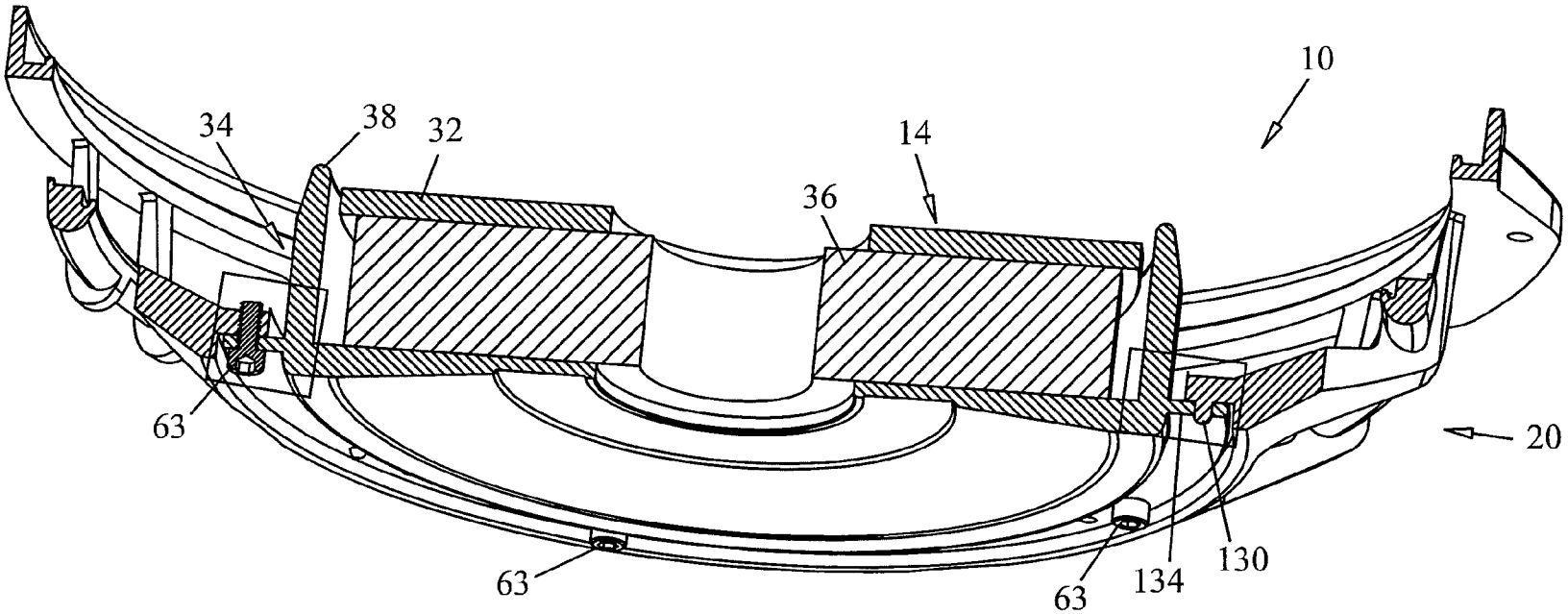
FIG. 15 is a view similar to FIG. 14 except with the loudspeaker assembled.
Figure 15B:
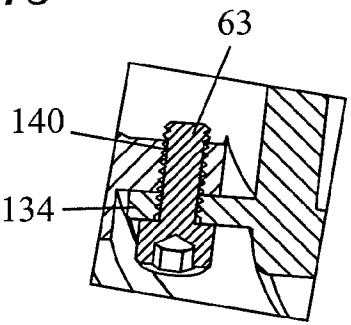
FIG. 15B is an enlarged view of the encircled portion on the left-hand side of FIG. 15 illustrating the fasteners which connect the frame and motor assembly together.
Figure 15A:
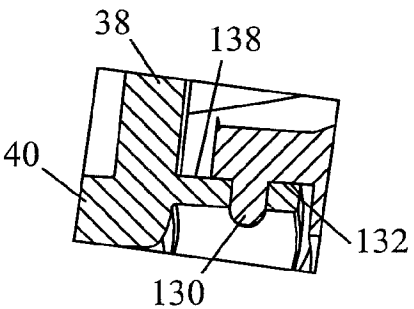
FIG. 15A is an enlarged view of the encircled portion on the right-hand side of FIG. 15 depicting the alignment connection between the frame and motor assembly.

Embodiment of FIGS. 14-15B

Referring now to FIGS. 14-15B, a still further embodiment of this invention is illustrated. The lower end 20 of frame 12 is formed with a number of circumferentially spaced pins 130 which extend downwardly, as shown in the orientation of the frame 12 in the Figs., from a vertical alignment surface 132. A flange 134 extends radially outwardly from the pot structure 34, approximately at the juncture of the pot wall 38 and back plate 40. The flange 134 is formed with a number of circumferentially spaced through bores 136 and an upper surface 138. When the frame 12 is fitted onto the motor structure 14, the pins 130 of the lower surface 20 of the frame extend into the through bores 136 in the flange 134, and the vertical alignment surface 132 rests atop the upper surface 138 of the flange 134. The location of the pins 130 on the lower surface 20 of the frame and the through bores 136 in the flange, ensure that accurate radial alignment of the voice coil 30 relative to the magnetic gap 42 is obtained. Similarly, the vertical positioning of the upper surface 138 of the flange 134 is such that when the vertical alignment surface 132 of the frame 12 rests thereon, the voice coil 30 is accurately vertically aligned within the magnetic gap 42. The frame 12 and motor assembly 14 are connected together by inserting screws 63 through the bores 136 in the flange 134 into tapped holes 140 formed in the lower end 20 of frame 12 and tightening down the screws 63.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the embodiment of FIGS. 5-6A a motor mounting plate 80 is shown which is essentially donut-shaped, e.g. a circular element with a hole in the middle corresponding to the central bore 44 in the magnet 36. In alternative embodiments (not shown), the plate 80 may take the form of an annular ring or a series of circumferentially spaced arc segments affixed to the base of the back plate 40. In both cases, the annular ring or arc segments extend only part way onto the base of the back plate 40 and protrude radially outwardly in the same way as the motor mounting plate 80 depicted in FIGS. 5-6A.

In still further embodiments of this invention, the motor mounting plate 80, annular ring and/or arc segments described above in connection with a discussion of alternative embodiments of FIGS. 5-6A could take the place of the flange 134 in the embodiment of FIGS. 14-15B. In those cases, the bores 136 which receive the pins 130 of the lower end 20 of frame 12 are formed in the plate 80, annular ring or arc segments instead of the flange 134.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a frame having a first end and a second end, said second end including a radial alignment surface and at least one vertical alignment member;

a voice coil coupled to and moveable relative to said frame;

a motor assembly including a top plate, a pot structure having a pot wall and a back plate, and a magnet located between said top plate and said back plate, said top plate being spaced from said pot wall to form a magnetic gap between them;

said pot wall of said pot structure being formed with a radial alignment surface and at least one notch extending radially inwardly relative to said radial alignment surface;

said frame being mounted to said motor assembly so that said radial alignment surface of said second end of said frame contacts said radial alignment surface of said pot wall, and said at least one vertical alignment member extends into said at least one notch in said pot wall, whereby said voice coil is radially and vertically aligned within said magnetic gap.

2. The loudspeaker of claim 1 in which said pot wall has an exterior surface which forms said radial alignment surface of said pot structure and engages said radial alignment surface of said second end of said frame.

3. The loudspeaker of claim 1 in which said at least one notch formed in said pot wall has a vertical alignment surface, said at least one vertical alignment member of said frame extending into engagement with said vertical alignment surface of said at least one notch.

4. The loudspeaker of claim 1 in which said at least one vertical alignment member comprises a number of set screws each of which extends through a bore formed in said second end of said frame.

5. The loudspeaker of claim 4 in which said at least one notch comprises a number of notches, each of said notches receiving one of said set screws to provide vertical alignment of said voice coil within said magnetic gap and to connect said frame to said motor assembly.

6. The loudspeaker of claim 1 in which said at least one notch comprises a number of notches each having a vertical alignment surface, said at least one vertical alignment member of said frame comprising a number of flexible arms each formed with a tip at one end, each of said tips being insertable into one of said notches and in engagement with said vertical alignment surface thereof to provide vertical alignment of said voice coil within said magnetic gap and to connect said frame to said motor assembly.

7. A loudspeaker, comprising:

a frame having a first end and a second end, said second end including a number of vertical alignment bores and a radial alignment surface;

a voice coil coupled to and moveable relative to said frame;

a motor assembly including a top plate, a pot structure having a pot wall and a back plate, and a magnet located between said top plate and said back plate, said top plate being spaced from said pot wall to form a magnetic gap between them;

said pot wall of said pot structure being formed with a radial alignment surface and a number of notches extending radially inwardly from said radial alignment surface;

said frame being mounted to said motor assembly so that said radial alignment surface of said second end of said frame contacts said radial alignment surface of said pot wall, and said vertical alignment bores of said frame align with said notches in said pot wall;

a connector extending through each of said vertical alignment bores in said frame and into one of said notches of said pot wall, whereby said voice coil is radially and vertically aligned within said magnetic gap.

8. The loudspeaker of claim 7 in which said pot wall has an exterior surface which forms said radial alignment surface of said pot structure and engages said radial alignment surface of said second end of said frame.

9. The loudspeaker of claim 7 in which said notches formed in said pot wall each has a vertical alignment surface, said connector comprising set screws each extending into one of said notches and into engagement with said vertical alignment surface thereof to provide vertical alignment of said voice coil within said magnetic gap and to connect said frame to said motor assembly.

* * * * *